US006273688B1

(12) United States Patent
Kawahara et al.

(10) Patent No.: US 6,273,688 B1
(45) Date of Patent: Aug. 14, 2001

(54) LINEAR COMPRESSOR

(75) Inventors: Sadao Kawahara; Teruyuki Akazawa, both of Shiga (JP)

(73) Assignee: Matsushita Electric Industrial Co., Ltd., Kodoma (JP)

( * ) Notice: Subject to any disclaimer, the term of this patent is extended or adjusted under 35 U.S.C. 154(b) by 0 days.

(21) Appl. No.: 09/415,502

(22) Filed: Oct. 12, 1999

(30) Foreign Application Priority Data

Oct. 13, 1998 (JP) ..... 10-306374
Nov. 19, 1998 (JP) ..... 10-3465544

(51) Int. Cl.[7] ..... F04B 17/04; F04B 35/04
(52) U.S. Cl. ..... 417/417; 417/363
(58) Field of Search ..... 417/417, 418, 417/410.1, 363, 415; 188/379; 62/6, 498

(56) References Cited

U.S. PATENT DOCUMENTS

| | | | | |
|---|---|---|---|---|
| 2,865,559 | | 12/1958 | Gigler . | |
| 3,947,155 | * | 3/1976 | Lilie et al. | 417/415 |
| 4,067,667 | * | 1/1978 | White | 417/418 |
| 4,179,630 | | 12/1979 | Stuber | 310/15 |
| 4,360,087 | * | 11/1982 | Curwen | 188/379 |
| 4,427,906 | | 1/1984 | Kainuma et al. | 310/27 |
| 4,781,546 | * | 11/1988 | Curwen | 417/417 |
| 4,924,675 | * | 5/1990 | Higham et al. | 62/6 |
| 5,354,185 | * | 10/1994 | Morinigo et al. | 417/410.2 |
| 5,727,932 | * | 3/1998 | McGrath | 417/417 |
| 5,772,410 | * | 6/1998 | Chang | 417/363 |
| 5,779,455 | * | 7/1998 | Steiger | 417/418 |
| 5,993,175 | * | 11/1999 | Kim et al. | 417/417 |
| 6,082,132 | * | 7/2000 | Numoto et al. | 62/498 |
| 6,092,999 | * | 7/2000 | Lilie et al. | 417/415 |

FOREIGN PATENT DOCUMENTS

| | | |
|---|---|---|
| 24 14 961 | 10/1975 | (DE) . |
| 92 06 748 | 8/1992 | (DE) . |
| 1 602 823 | 2/1971 | (FR) . |
| 374256 | 6/1932 | (GB) . |
| 9-195938 | 7/1997 | (JP) . |
| WO 97/01032 | 1/1997 | (WO) . |
| WO 97/01033 | 9/1997 | (WO) . |

* cited by examiner

*Primary Examiner*—Teresa Walberg
*Assistant Examiner*—Leonid Fastovsky
(74) *Attorney, Agent, or Firm*—Armstrong, Westerman, Hattori, McLeland & Naughton, LLP

(57) ABSTRACT

A linear compressor disclosed herein includes a cylinder whose axial direction is directed to a horizontal direction. The linear compressor comprises a cylinder supported in a hermetic vessel by a supporting mechanism, a piston slidably supported along an axial direction of the cylinder concentrically with the cylinder, and a linear motor for generating thrust force by forming a magnetic passage by a movable portion secured to the piston and a stationary portion secured to the cylinder. The supporting mechanism comprises first and second coil springs supporting the cylinder from its opposite ends in the hermetic vessel, and at least one of the first and second coil springs comprises a plurality of coil springs which are juxtaposed to each other.

16 Claims, 5 Drawing Sheets

LINEAR COMPRESSOR

BACKGROUND OF THE INVENTION (1) Field of the Invention

The present invention relates to a linear compressor in which a cylinder slidably supporting a piston is supported in a hermetic vessel by a coil spring.

(2) Description of the Prior Art

In refrigeration cycle, it is said that HCFC-based refrigerants such as R22 are stable compounds and decompose the ozone layer. In recent years, HFC-based refrigerants begin to be utilize as alternative refrigerants of HCFCs, but these HFC-based refrigerants have the nature for facilitating the global warming. Therefore, people start employing HC-based refrigerants which do not decompose the ozone layer or largely affect the global warming.

However, since this HC-based refrigerant is flammable, it is necessary to prevent explosion or ignition so as to ensure the safety. For this purpose, it is required to reduce the amount of refrigerant to be used. On the other hand, the HC-based refrigerant itself does not have lubricity and is easily melted into lubricant. For these reasons, when the HC-based refrigerant is used, an oilless or oil pure compressor is required, and a linear compressor in which almost no load is applied in a direction perpendicular to an axis of its piston is effective.

In the case of the linear compressor, since a compressing mechanism vibrates, it is necessary to prevent the vibration from being transmitted outside.

Further, the linear compressor is known as a compressor of a type in which oilless can be realized easier as compared with a reciprocating compressor, a rotary compressor and a scroll compressor.

However, even in this linear compressor, there exist sliding surfaces between its cylinder and piston, the sliding performance between the sliding surfaces has a great effect on both efficiency and durability of the linear compressor. Therefore, in order to make the linear compressor into an oilless compressor, very complicated design is required.

SUMMARY OF THE INVENTION

Thereupon, it is a first object of the present invention to reduce vibration of a linear compressor transmitted to a hermetic vessel without increasing outer dimensions of the hermetic vessel.

It is a second object of the invention to provide a supporting mechanism capable of effectively suppressing not only vibration generated in an axial direction of a piston but also vibration generated in a direction perpendicular to the axial direction of the piston.

When a cylinder is supported by a plurality of coil springs, it is a third object of the invention to provide a linear compressor capable of using the same coil springs without considering the characteristics of the coil springs corresponding to respective positions to be placed.

It is a fourth object of the invention to effectively utilize a space in a hermetic vessel generated by coil spring-supporting structure, thereby enhancing the resistance to vibration of a discharge tube.

It is a fifth object of the invention to provide a high efficiency and highly reliable linear compressor by reliably supplying lubricant to necessary portions of the linear compressor.

A linear compressor according to the present invention comprises a cylinder supported in a hermetic vessel by a supporting mechanism, a piston slidably supported along an axial direction of the cylinder concentrically with the cylinder, and a linear motor for generating thrust force by forming a magnetic passage by a movable portion secured to the piston and a stationary portion secured to the cylinder. The axial direction of the cylinder is directed in a horizontal direction. The supporting mechanism comprises first and second coil springs supporting the cylinder from its opposite ends in the hermetic vessel, and at least one of the first and second coil springs comprises a plurality of coil springs which are juxtaposed to each other.

The linear compressor of the present invention includes a lubricant supplying apparatus.

DESCRIPTION OF THE PREFERRED EMBODIMENTS

Embodiments of a linear compressor of the present invention will be explained based on the drawings below.

Figure 1:
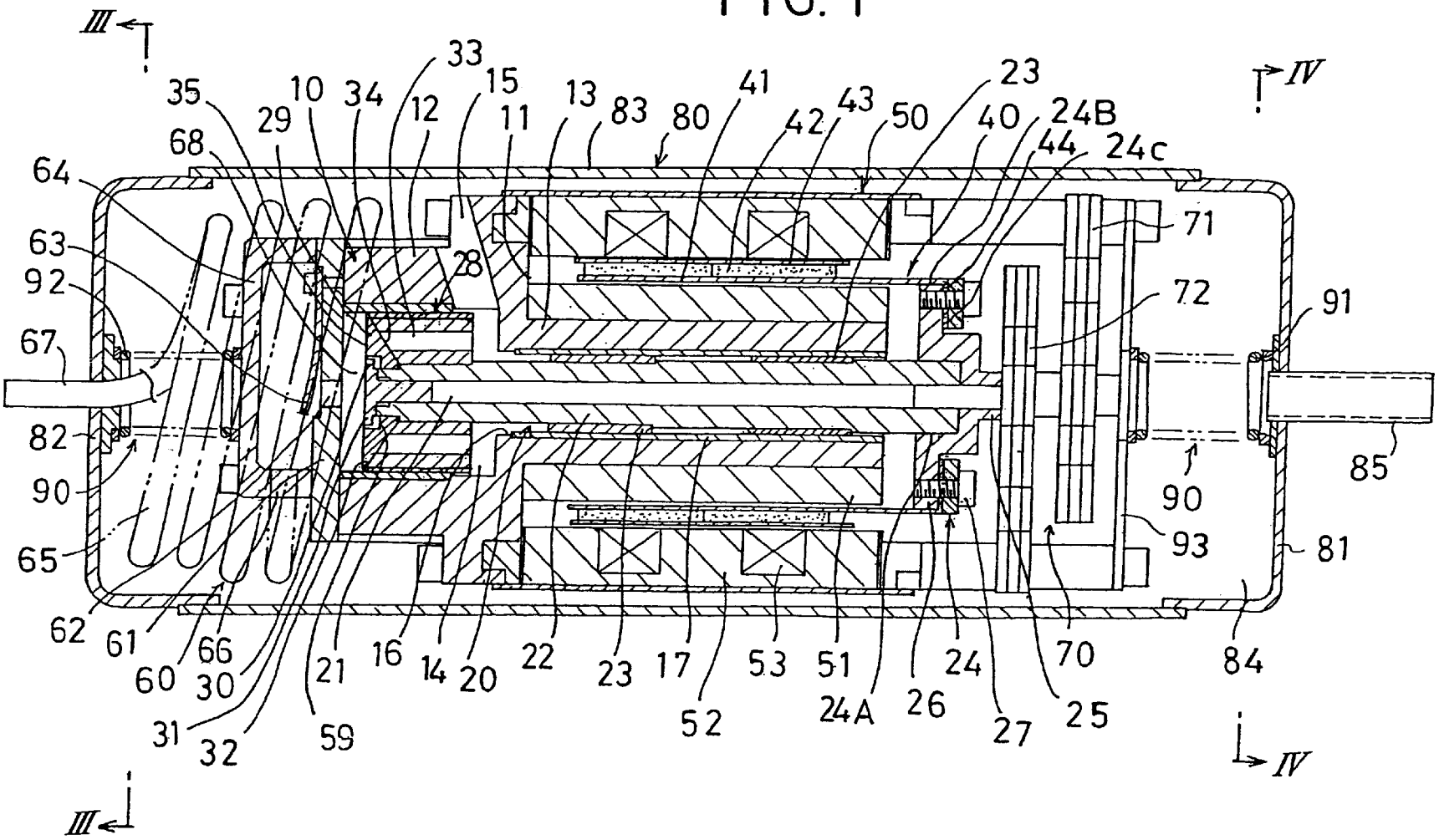
FIG. 1 is a sectional view showing the entire structure of a linear compressor according to an embodiment of the present invention.

FIG. 1 shows the entire structure of a linear compressor according to a first embodiment of the present invention. This linear compressor comprises a cylinder 10, a piston 20, a movable portion 40 as well as a stationary portion 50 both constituting a linear motor, a discharge mechanism 60, a spring mechanism 70, a hermetic vessel 80 and a supporting mechanism 90.

The cylinder 10 comprises a brim 11, a boss 12 projecting leftward from the brim 11 as viewed in FIG. 1, and a cylindrical portion 13 for holding the piston 20. These brim 11, the boss 12 and the cylindrical portion 13 are integrally formed. A space 14 forming a compressing chamber in which a piston body 28 is disposed is formed in the boss 12 such that one end of the space 14 is opened. An intake port 15 provided at the side of the brim 11 is in communication with the space 14. A cylinder hole 16 formed in the cylindrical portion 13 is in communication with the space 14 and is opened at its rear end (right side in the drawing). A ring 17 made of thin metal material is fitted to an inner surface of the cylinder hole 16. In the present embodiment, the cylinder 10 is made of aluminum material, and the ring 17 is provided for enhancing the sliding performance.

The piston 20 comprises a rod 22 forming an inner hole 21, and a piston body 28. In the present embodiment, the piston 20 is made of aluminum material. By making the piston 20 of aluminum material, it is possible to reduce the piston 20 in weight, and to lower the rigidity of the spring mechanism 70 which will be explained later.

In the piston 20, in order to enhance the wear resistance, a divided steel thin liner 23 is fitted to outer peripheries of the rod 22 and the piston body 28. The steel thin liner 23 is slidably held by a ring 17 at the side of the cylinder 10. The piston 20 is provided at its rear end (right side in the drawing) with a flange 24, and at its front end (left side in the drawing) with the piston body 28. The flange 24 is formed at its central portion with a hold 24A to which the piston 20 is fitted, and comprises a side surface 24B which is concentric with an axis of the piston 20, an end surface 24C formed perpendicular to the axis of the piston 20 and adjacent the side surface 24B, and a connection shaft 25 to be connected to the spring mechanism 70. A ring-like pushing plate 26 for abutting against the end surface 24C is connected to the flange 24 by bolts 27.

The piston body 28 comprises an on-off valve 29 provided at the side of an opening in a front end of the piston 20, and a stopper member 31 for forming a stopper 30 which movably supports the on-off valve 29 in its axial direction and regulates the moving amount of the suction valve 29. The piston body 28 is formed at its opening side front end with a tapered surface 32.

The piston body 28 is further formed with a plurality of through holes 33 through which intake refrigerants pass. The through holes 33 are in communication with the intake port 15. The stopper member 31 is secured to a tip end of the rod 22 such that a shaft of the stopper member 31 is fitted into the inner hole 21 of the piston 20. On the other hand, the suction valve 29 has a tapered portion which abuts against the tapered surface 32 of the piston body 28. The on-off valve 29 is provided at its front end with a cone-like member forming a flat surface 35, and is slidably supported by a tip end of the piston 20.

With the above-described structure, the suction valve 29 is capable of moving along the axial direction of the piston 20. When the on-off valve 29 moves in a refrigerant compressing direction of the piston 20, the tapered portion 34 of the on-off valve 29 abuts against the tapered surface 32 of the piston body 28 to close the through holes 33.

Although the rod 22, the piston body 28 and the flange 24 are separately formed in the present embodiment as shown in FIG. 1, it is also possible to integrally form the rod 22 and the piston body 28, or the rod 22 and the flange 24.

The linear motor will be explained next. The linear motor comprises the movable portion 40 and the stationary portion 50. The movable portion 40 comprises a cylindrical holding member 41, a permanent magnet 42 and a cylindrical body 43. The stationary portion 50 comprises an inner yoke 51, an outer yoke 52 and a coil 53.

All of the cylindrical holding member 41, the permanent magnet 42 and the cylindrical body 43 of the movable portion 40 are cylindrical in shape, and are disposed concentrically with the piston 20. The cylindrical holding member 41 is made of thin member and is formed at its rear end with a flange surface 44. The cylindrical holding member 41 is disposed in a state where it is in contact with the side surface 24B and the end surface 24C of the flange 24.

The permanent magnet 42 is disposed such as to be in contact with the cylindrical holding member 41. The cylindrical body 43 is disposed such as to be in contact with the permanent magnet 42. In the present embodiment, the permanent magnet 42 is sandwiched between the cylindrical holding member 41 and the cylindrical body 43. The cylindrical holding member 41, the permanent magnet 42 and the cylindrical body 43 are disposed concentrically with the piston 20 with high precision.

The stationary portion 50 comprises the inner yoke 51, the outer yoke 52 and the coil 53. The inner yoke 51 is cylindrical in shape and in contact with the cylindrical portion 13 and secured to the brim 11. A fine gap is formed between an outer periphery of the inner yoke 51 and the cylindrical holding member 41. The inner yoke 51, the cylinder 10 and the piston 20 are disposed concentrically.

The outer yoke 52 is also cylindrical in shape, and is disposed such that a fine gap is formed between the outer yoke 52 and an outer periphery of the cylindrical body 43. The outer yoke 52 is secured to the brim 11 of the cylinder 10. The movable portion 40 and the stationary portion 50 are concentrically held with high precision.

Figure 2:
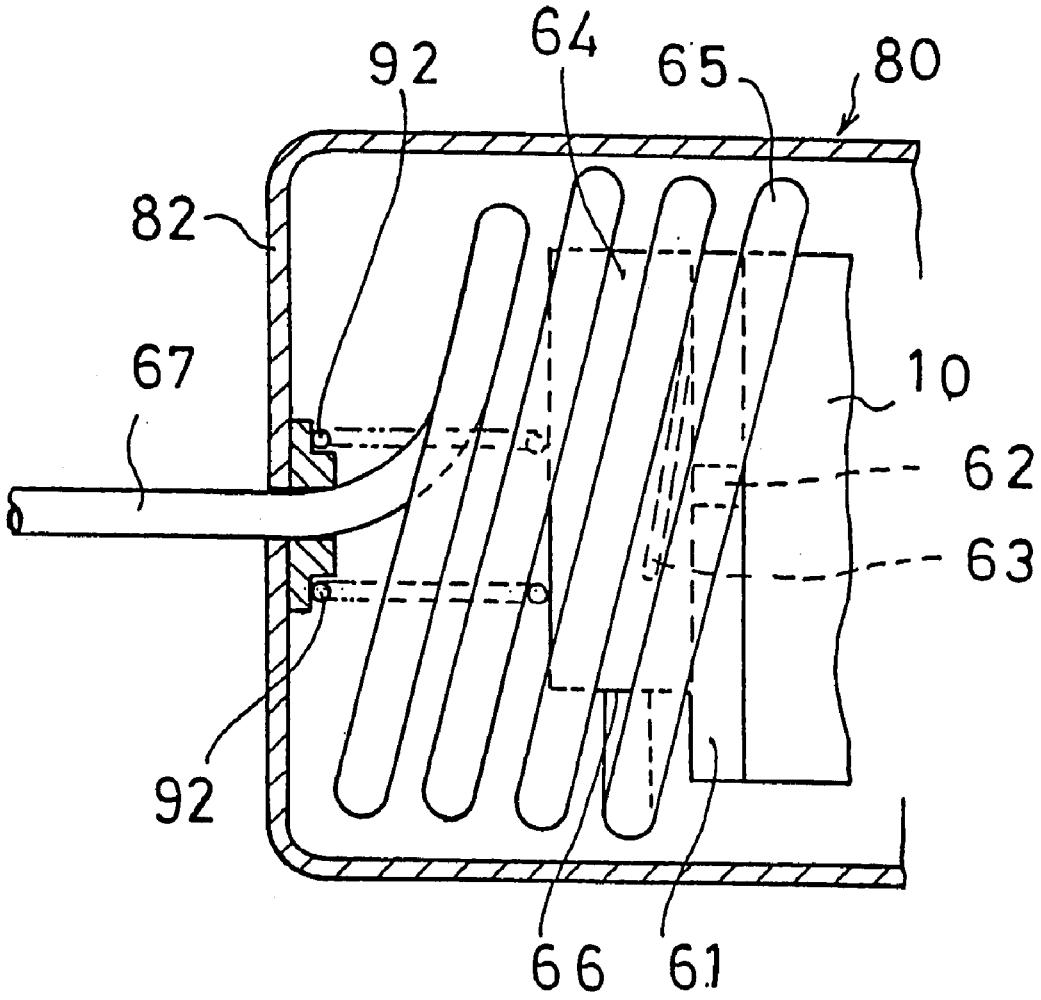
FIG. 2 is an enlarged sectional view of an essential portion showing a discharge mechanism according to the embodiment.

Next, the discharge mechanism 60 will be explained. FIG. 2 is a partially sectional view showing the discharge mechanism 60.

A discharge valve supporting member 61 is secured to a front end of a cylinder 10, and a discharge hole 62 is formed in a central portion of the discharge valve supporting member 61. A discharge valve 63 is connected to the discharge hole 62. A muffler 64 is secured to the discharge valve supporting member 61. A base end of a spiral discharge tube 65 is connected to a discharge port 66 of the muffler 64, and a front end of the spiral discharge tube 65 is connected to a discharge tube 67.

As shown in FIG. 2, the spiral discharge tube 65 is made of pipe member which is bent into a spiral shape. A portion of the spiral discharge tube 65 is wound around outer peripheral spaces of the cylinder 10 and the muffler 64. By winding the portion of the spiral discharge tube 65 around the outer peripheral spaces of the cylinder 10 and the muffler 64 in this manner, it is possible to further shorten the overall length of the hermetic vessel 80. A spring constant of the spiral discharge tube 65 is set smaller than that of the supporting mechanism 90. By setting the spring constant of the supporting mechanism 90 greater than that of the discharge tube 65, the vibration of the cylinder is reliably prevented by the supporting mechanism 90, and load on the discharge tube 65 can be reduced. Therefore, the resistance to vibration of the discharge tube 65 can be enhanced, and the discharge tube 65 can reliably be prevented from being damaged.

The spiral discharge tube 65 and the discharge tube 67 may be integrally formed, or may be formed separately and connected to each other.

Next, the spring mechanism and the hermetic vessel 80 will be explained.

The spring mechanism 70 comprises flat plate-like spring plates 71 and 72. As shown in the drawing, the spring plates 71 and 72 are disposed such that rear ends of the cylinder 10 and the piston 20 are bridged with the spring plates 71 and 72.

The hermetic vessel 80 is a cylindrical vessel comprising a rear end plate 81, a front end plate 82 and a cylindrical body 83 secured between the rear end plate 81 and the front end plate 82, and the hermetic vessel 80 is formed with a space 84 therein. Constituent elements of the linear compressor are accommodated in the space 84. The rear end plate 81 is provided with an suction tube 85, and the front end plate 82 is provided with the discharge tube 67.

By providing the suction tube 85 at the end of the hermetic vessel, it is possible to provide the suction tube 85 by utilizing a space required for disposing the supporting mechanism. Therefore, in a high pressure type compressor, it is possible to elongate the suction tube 85 or employ a vibration resistance structure capable of withstanding the vibration.

Similarly, by providing the discharge tube 67 at the end of the hermetic vessel, it is possible to provide the discharge tube 67 by utilizing a space required for disposing the supporting mechanism. Therefore, in a low pressure type compressor, it is possible to elongate the discharge tube 67 or employ a vibration resistance structure capable of withstanding the vibration. Further, in the case of the high pressure type compressor, when lubricant is used as will be described later, a space for separating oil can be formed.

Figure 3:
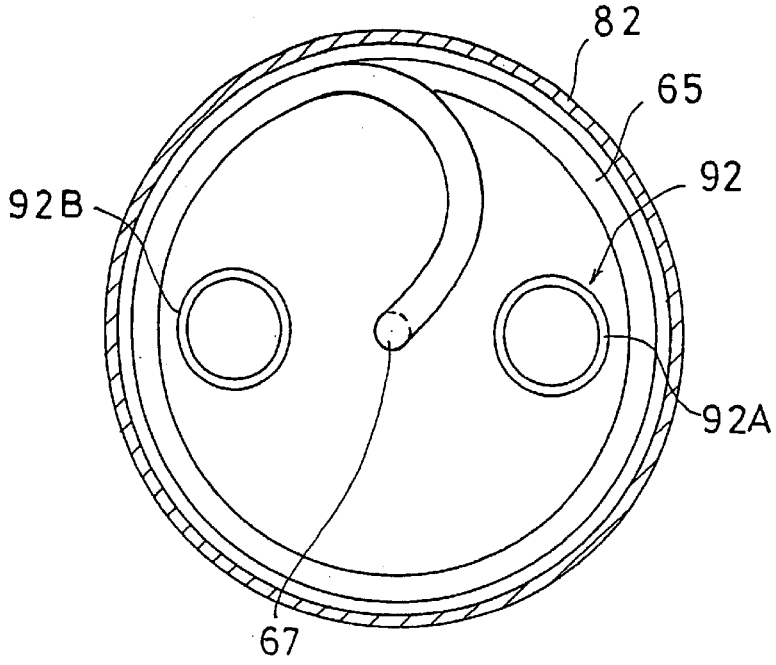
FIG. 3 is a sectional view taken along the line III—III in FIG. 1.
Figure 4:
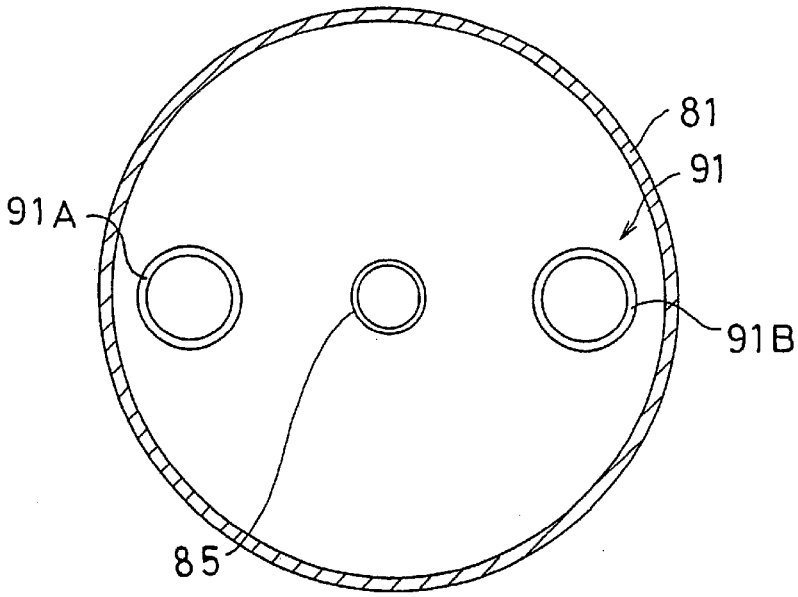
FIG. 4 is a sectional view taken along the line IV—IV in FIG. 1.

Next, the supporting mechanism 90 will be explained. FIG. 3 is a sectional view taken along the line III—III in FIG. 1, and FIG. 4 is a sectional view taken along the line IV—IV in FIG. 1.

The supporting mechanism 90 comprises a rear end coil spring 91 and a front end coil spring 92. The rear end coil spring 91 is disposed between a bridging plate 93 secured to the cylinder 10 and the rear end plate 81 of the hermetic vessel 80. The front end coil spring 92 is disposed between a front surface of the muffler 64 and the front end plate 82 of the hermetic vessel 80. In this manner, the rear end coil spring 91 and the front end coil spring 92 support the cylinder from its opposite sides. The rear end coil spring 91 comprises two coil springs 91A and 91B juxtaposed to each other in the lateral direction, and the front end coil spring 92 comprises two coil springs 92A and 92B juxtaposed to each other in the lateral direction. Since the rear and front end coil springs 91 and 92 are provided with the same number of coil springs in this manner, the weight of the cylinder is commonly applied to the rear and front end coil springs 91 and 92 and thus, substantially the same load is applied to each of the rear end coil springs 91A and 91B and the front end coil springs 92A and 92B, and coil springs having the same spring constant can be used. Further, since each of the front coil spring and the rear coil spring comprises two coil springs, it is possible to enhance the resistance to vibration, to form sufficient space around the supporting mechanism, and to secure a space for winding the discharge tube or the like for example.

In the present embodiment, each of the front end coil spring 92 and the rear end coil spring 91 comprises two coil springs juxtaposed to each other. However, if at least one of the front end coil spring 92 and the rear end coil spring 91 comprises two coil springs, it is possible to effectively suppress the vibration in a direction perpendicular to the axial direction of the cylinder 10, and it is possible to stably support the cylinder 10 with excellent balance. At that time, in the case of the structure as in the present embodiment, it is preferable to reduce the number of the front end coil springs 92 as compared with the number of the rear end coil springs 91. With such a design, it is possible to secure a sufficient space for winding the spiral discharge tube 65, and to enhance the resistance to vibration of the discharge tube 65.

In the above embodiment, the two coil springs 92A and 92B constituting the front end coil spring 92, and the two coil springs 91A and 91B constituting the rear end coil spring 91 are juxtaposed to each other in the lateral direction. However, they may be disposed in the vertical direction or at another angle. Further, if each of the front and rear end coil springs comprises three or more coil springs, it is possible to reduce the spring constant of one coil spring, which makes it possible to further enhance the resistance to vibration. However, in order to sufficiently secure the space for winding the spiral discharge tube 65, the smaller number coil springs is preferable, and three or less is preferable.

The operation of the linear compressor of the present embodiment will be explained.

First, if the coil 53 of the stationary portion 50 is energized, thrust force which is proportional to the current in accordance with Fleming's left-hand rule is produced between the movable portion 40 and the permanent magnet 42. By this produced thrust force, driving force for retreating the movable portion 40 along the axial direction is generated. Since the cylindrical holding member 41 of the movable portion 40 is secured to the flange 24, and the flange 24 is connected to the piston 20, the piston 20 is retreated. Since the piston 20 is slidably supported in the cylinder 10, the piston 20 is retreated along its axial direction. Since the suction valve 29 provided at the front end of the piston 20 is freely supported by the piston body 28, a gap is generated therebetween by the retreating motion of the piston 20.

Since the coil 53 is energized with sine wave, thrust force in the normal direction and thrust force in the reverse direction are alternately generated in the linear motor. By the alternately generated thrust force in the normal direction and thrust force in the reverse direction, the piston 20 reciprocates.

The refrigerant is introduced into the hermetic vessel 80 from the suction tube 85. The refrigerant introduced into the hermetic vessel 80 passes mainly around the outer periphery of the outer yoke 52 and enters into the space 14 of the cylinder 10 from the intake port 15 of the cylinder 10. This refrigerant enters into the intake compressing chamber 68 from the gap generated between the tapered portion 34 of the suction valve 29 and the tapered surface 32 of the piston body 28 by the retreating motion of the piston 20. The refrigerant in the intake compressing chamber 68 is compressed by the advancing motion of the piston 20. The compressed refrigerant opens the discharge valve 63, passes through the discharge hole 62 of the discharge valve supporting member 61, enters into the muffler 64 where the refrigerant is dispersed and noise is reduced, and the refrigerant enters into the spiral discharge tube 65 from the discharge port 66, and the refrigerant is discharged outside from the discharge tube 67.

The vibration of the cylinder 10 caused by the reciprocating motion of the piston 20 is suppressed by the rear end coil spring 91 and the front end coil spring 92.

As described above, according to the present embodiment, it is possible to reduce the vibration transmitted to the hermetic vessel without increasing the outer dimension of the hermetic vessel. That is, it is possible to effectively suppress not only vibration generated in the axial direction of the piston by the rear end coil spring 91 and the front end coil spring 92, but also vibration generated in a direction perpendicular to the axial direction of the piston. Further, the cylinder and the like can be stably supported with excellent balance. Furthermore, common spring members can be used for the coil springs 91 and 92, it is possible to easily manage the parts and to reduce the costs. Further, by winding the discharge tube into a spring shape and by increasing the spring constant of the supporting mechanism greater than that of the discharge tube, it is possible to enhance the resistance to vibration, and to shorten the overall length of the compressor, thereby reducing the compressor in size.

Figure 5:
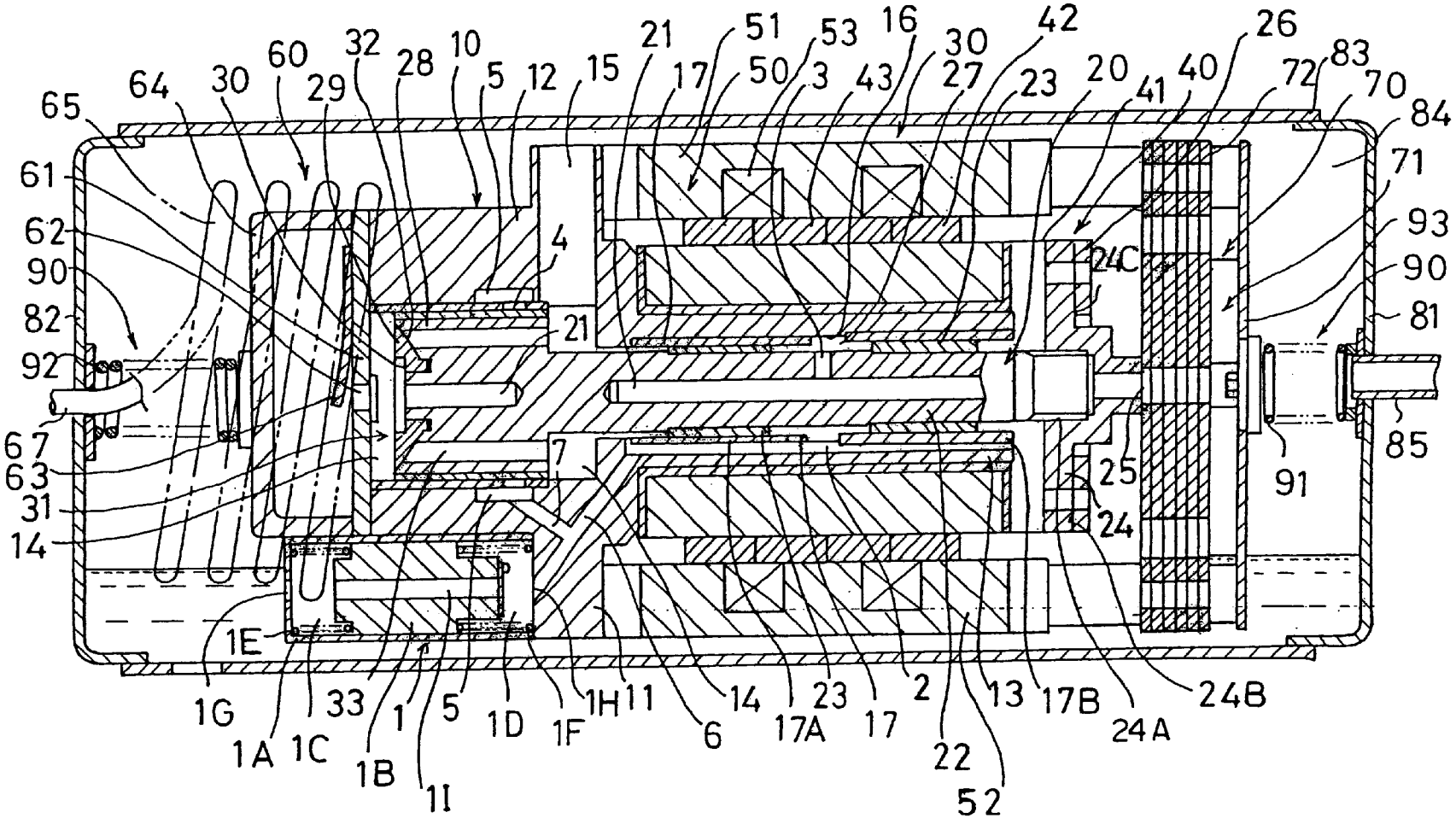

FIG. 5 shows the entire structure of a linear compressor according to another embodiment of the present invention. This linear compressor corresponds to that shown in FIG. 1 except that a lubricant supplying apparatus is added to a lower portion of the cylinder 10. In FIG. 5, constituent elements corresponding to the same elements shown in FIG. 1 including slightly different portions are designated with the same reference symbols. Here, portions different from those shown in FIG. 1 will be explained mainly.

The lubricant supplying apparatus 1 comprises a cylinder case 1A, a piston 1B accommodated in the cylinder case 1A for reciprocating motion, and springs 1E and 1F respectively disposed in an intake space 1C and a discharge space 1D formed between the opposite ends of the piston 1B and the end surfaces of the cylinder case 1A. The cylinder case 1A is formed with an intake port 1G which is in communication with the intake space 1C at its one end side and with a discharge port 1H which is in communication with the discharge space 1D at the other end side.

The piston 1B includes a passage 1I which brings the intake space 1C and the discharge space 1D into communication with each other. The passage 1I includes a valve body 1J (FIG. 6) through which lubricant can move only from the intake space 1C to the discharge space 1D.

The cylinder 10 is formed at its inner peripheral surface with an oil groove 2 along the axial direction of the piston 20. The oil groove 2 is continuously extended up to the rear end of the cylinder 10.

A liner 17C is fitted to the boss 12 of the cylinder 10 in which the piston body 28 of the piston 20 is inserted. The liner 17C is formed with an oil hole 4. The oil hole 4 is formed at a position opposite from the compression chamber with respect to the center position of the sliding region of the piston body 28.

By disposing the oil hole 4 at the position away from the compressing chamber in this manner, it is possible to reduce the amount of lubricant flowing into the compressing chamber, and to lubricate the sliding surface of the piston body 28. Therefore, it is possible to prevent the lubricant from being discharged from the hermetic vessel 80 together with the compressed refrigerant. The oil groove 5 is formed in the cylinder 10 such as to be in communication with the oil hole 4.

The cylinder 10 is provided with an oil passage 6 which brings the discharge port 1H of the lubricant supplying apparatus 1 and the oil groove 2 into communication with each other. The oil passage 6 is in communication with the oil groove 5 through an oil passage 7.

The flange 24 is detachably threaded to the piston 20. Each of the steel thin liners 23 is inserted to an outer periphery of the rod 22 from the side of the flange 24, and the position of the liner 23 is restricted by a step portion. A gap 27 is formed between the front and rear steel thin liners 23. An upper portion of the outer periphery of the rod 22 of the piston 20 opposed to the gap 27 is formed with a through hole 3. The through hole 3 is in communication with the inner hole 21.

The suction valve 29 is formed with a step surface 36 which abuts against the stopper 30 through an appropriate distance. With the above-described structure, the suction valve 29 is capable of moving along the axial direction of the piston 20 by the above-mentioned distance. When the piston 20 moves in a direction to compress the refrigerant, the tapered portion 23 of the suction valve 29 abuts against the tapered surface 32 of the piston body 28 to close the through hole 33.

Although the rod 22 and the piston body 28 are integrally formed, they may be formed as separate members.

The cylindrical holding member 41 is fitted to the flange 24 or secured by securing means which is not shown. The cylindrical holding member 41 is disposed concentrically with the piston 20.

The operation of the linear compressor of the present embodiment will be explained. The reciprocating motion of the piston 20, as well as intake, compressing, discharge operations of the refrigerant are the same as those shown in FIG. 1 and thus, these explanation will be omitted.

Figure 6:
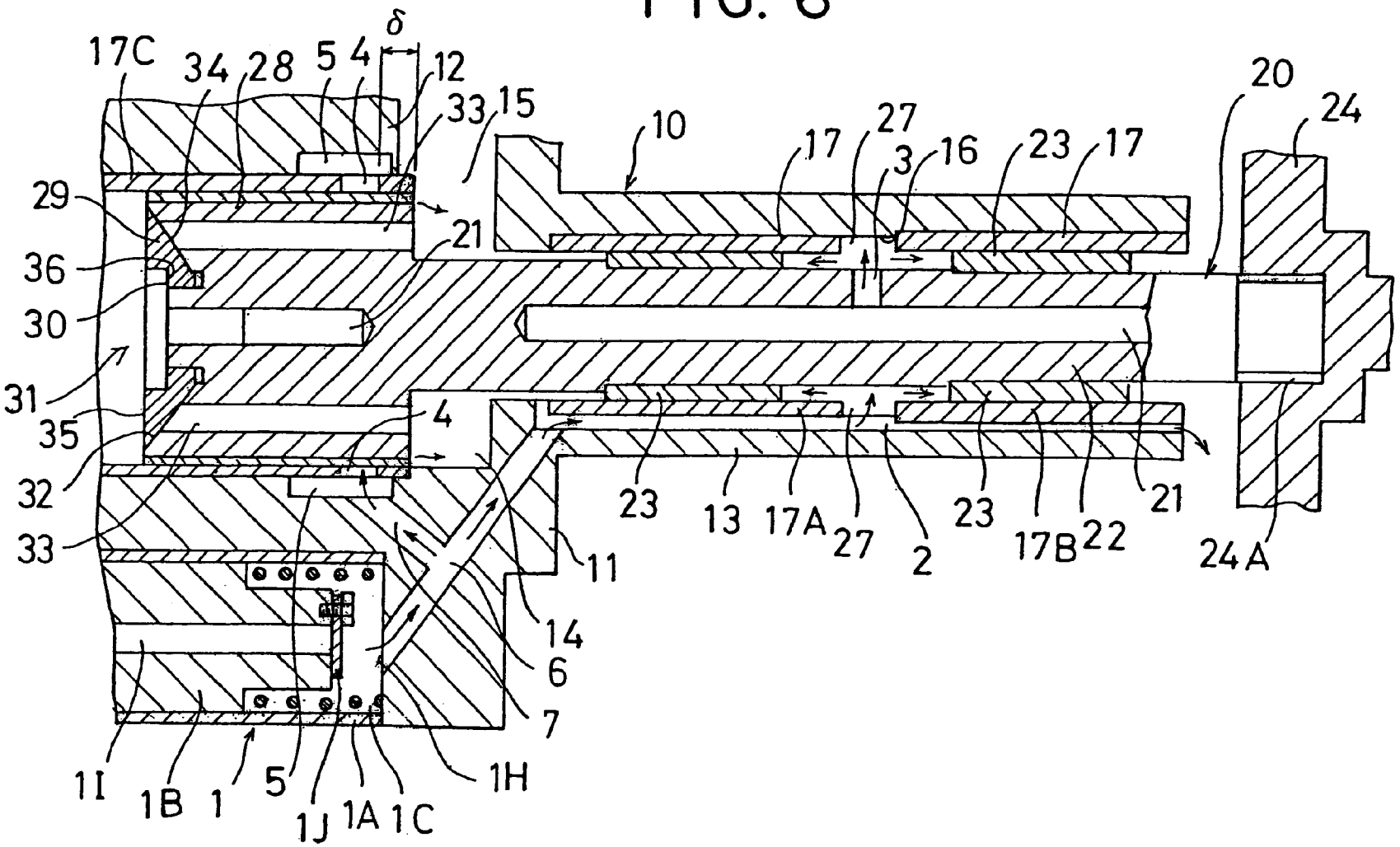
FIG. 6 is an enlarged sectional view of an essential portion showing lubricant paths in FIG. 5 in detail.

Lubricating operation of the cylinder 10 and the piston 20 by the operation of the lubricant supplying apparatus 1 of the present embodiment will be explained with reference to FIG. 5 and FIG. 6 which is a partial enlarged view of FIG. 5.

Since the cylinder 10 is resiliently supported by the hermetic vessel 80, the cylinder 10 vibrates by the reciprocating motion of the piston 20. With this vibration, the lubricant supplying apparatus 1 secured to the cylinder 10 also vibrates.

Therefore, the piston 1B supported by the cylinder case 1A through the spring horizontally reciprocates in the cylinder case 1A. By moving the piston 1B toward the intake space 1C, the lubricant in the intake space 1C passes through the passage 1K and moves to the discharge space 1D.

If the piston 1B moves toward the discharge space 1D, since the valve body 1J closes the passage 1K, the lubricant in the discharge space 1D is introduced into the oil passage 6 from the discharge port 1H. The lubricant introduced into the oil passage 6 diverges into the oil passage 7 and the oil groove 2. The lubricant entering the oil passage 7 enters into the oil groove 5, and enters from the oil hole 4 into a gap between the inner surface of the liner 17C of the cylinder 10 and the steel thin liner 23 of the outer surface of the piston body 28 for lubrication. On the other hand, the lubricant entering the oil groove 2 enters into the gap of the steel thin liner 23 from the space between liners 17A and 17B for lubrication. By supplying the lubricant between the divided liners 17A and 17B in this manner, it is possible to hold the lubricant in the space between the piston 20 and the cylinder 10 formed between the liners 17A and 17B.

Since the through hole 3 is formed in the upper portion of the piston 20, the lubricant introduced into the gap 28 is introduced from below to above for lubricating the side and upper sides. Therefore, it is possible to shorten the supply passage.

Since the lubricant flows down into the bottom of the hermetic vessel 80 through the inner hole 21 which opens at the rear end from the through hole 3, new lubricant is always supplied from the lubricant supplying apparatus 1.

By supplying the lubricant to the sliding surfaces between the piston 20 and the cylinder 10 in this manner, it is possible to provide an efficient and reliable linear compressor.

Further, as shown in FIG. 5, the axial direction of the cylinder 10 is directed to the horizontal direction to form a horizontal linear compressor, it is possible to bring the sliding portions between the piston 20 and the cylinder 10 closer to the lubricant level in the bottom of the hermetic vessel 80. Therefore, it is possible to lower the lubricating portion, and to shorten the supply passage of the lubricant, and it is possible to reliably supply the lubricant even through the amount of lubricant is small.

Further, by introducing the lubricant supplied to the outer periphery of the piston to the center hole from the through hole formed in the upper portion of the piston, it is possible to reliably supply the lubricant to the upper portion of the piston. That is, in the linear compressor, since the piston does not rotate but slides in the horizontal direction, the lubricant supplied from below does not easily flow upward. However, if the lubricant is introduced out from upper portion as in the present embodiment, the lubricant flows upward from below through the side of the piston and therefore, it is possible to supply the lubricant from the side surface to the upper portion of the piston.

Although the steel thin liner 23 is fitted to the rod 22 of the piston 20 in the present embodiment, an oil groove may be formed in the outer periphery of the rod 22.

In the present embodiment, since it is possible to reliably supply the lubricant to the necessary portion in the linear compressor, it is possible to provide an efficient and reliable linear compressor.

What is claimed is:

1. A linear compressor comprising a cylinder supported in a hermetic vessel by a supporting mechanism, a piston slidably supported along an axial direction of said cylinder concentrically with said cylinder, and a linear motor for generating thrust force by forming a magnetic passage by a movable portion secured to said piston and a stationary portion secured to said cylinder, wherein said supporting mechanism comprises first and second coil springs supporting said cylinder from its opposite ends in said hermetic vessel such that substantially a same load is applied to each of the first and second coil springs, and at least one of said first and second coil springs comprises a plurality of coil springs which are juxtaposed to each other.

2. A linear compressor according to claim 1, wherein said first and second coil springs comprise the same number of coil springs.

3. A linear compressor according to claim 2, wherein said axial direction of said cylinder is directed in a horizontal direction, each of said first and second coil springs comprises two coil springs juxtaposed to each other in the lateral direction.

4. A linear compressor according to claim 1, wherein said hermetic vessel is provided at its end with a discharge tube for discharging compressed refrigerant outside.

5. A linear compressor according to claim 1, wherein said hermetic vessel is provided at its end with an intake tube for introducing compressed refrigerant inside.

6. A linear compressor according to claim 1, wherein said cylinder is formed at its one end with a compressing chamber, said hermetic vessel is provided at its one end corresponding to said one end of said cylinder with a discharge tube for discharging out the refrigerant compressed in said compressing chamber, said first coil spring supports said one end of said cylinder, and the number of coil springs which constitute said second coil spring is set larger than the number of coil springs constituting said first coil spring.

7. A linear compressor comprising a cylinder supported from its opposite ends in a hermetic vessel by a supporting mechanism, a piston slidably supported along an axial direction of said cylinder concentrically with said cylinder, and a linear motor for generating thrust force by forming a magnetic passage by a movable portion secured to said piston and a stationary portion secured to said cylinder, wherein said cylinder is formed at its one end with a compressing chamber, said linear compressor further comprises a discharge tube for discharging refrigerant compressed in said compressing chamber out from said hermetic vessel, said discharge tube is wound, into a spring shape, around an outer periphery of one end of said supporting mechanism, and spring constant of said one end of said supporting mechanism is set greater than that of said discharge tube.

8. A linear compressor according to claim 7, where in a portion of said discharge tube is disposed on an outer periphery of said cylinder.

9. A linear compressor comprising a cylinder resiliently supported in a hermetic vessel, a piston slidably supported along an axial direction of said cylinder concentrically with said cylinder, and a linear motor for generating thrust force for reciprocating said piston in its axial direction by forming a magnetic passage by a movable portion secured to said piston and a stationary portion secured to said cylinder, so that lubricant is contained in said hermetic vessel, wherein said cylinder is provided at its lower portion with a lubricant supplying apparatus, said lubricant supplying apparatus supplies lubricant retained in a bottom of said hermetic vessel to sliding surfaces between said piston and said cylinder.

10. A linear compressor according to claim 9, wherein said lubricant supplying apparatus includes a sliding member slidably supported in a cylinder case, and a sliding direction of said sliding member is set to an axial direction of said piston.

11. A linear compressor according to claim 10, wherein said sliding member is supported in said cylinder case by a resilient member.

12. A linear compressor according to claim 9, wherein a liner is provided on at least one of an outer periphery of said piston and an inner periphery of said cylinder, said liner is divided in the axial direction of said piston, and lubricant supplied by said lubricant supplying apparatus is supplied between said divided liners.

13. A linear compressor according to claim 9, wherein a piston body is formed at the side of a compressing chamber of said piston, said cylinder is formed at its inner peripheral surface with an oil groove for supplying lubricant to an outer peripheral surface of said piston body, and said oil groove is located at opposite side from said compressing chamber with respect to a central position of a sliding region of said piston body.

14. A linear compressor according to claim 9, wherein an axial direction of said cylinder is directed to a horizontal direction.

15. A linear compressor according to claim 14, wherein lubricant supplied by said lubricant supplying apparatus is supplied to an outer periphery of said piston from below, said piston is formed at its upper portion with a through hole which is in communication with an inner hole of said piston, and lubricant supplied to said outer periphery of said piston is introduced into said inner hole from said through hole.

16. A linear compressor comprising a cylinder supported in a hermetic vessel by a supporting mechanism, a piston slidably supported along an axial direction of said cylinder concentrically with said cylinder, a linear motor for generating thrust force by forming a magnetic passage by a movable portion secured to said piston and a stationary portion secured to said cylinder, and a lubricant supplying means disposed in a lower portion of said cylinder for supplying lubricant to sliding surfaces between said piston and said cylinder by vibration of said cylinder, wherein said supporting mechanism comprises first and second coil springs supporting said cylinder from its opposite ends in said hermetic vessel, and at least one of said first and second coil springs comprises a plurality of coil springs which are juxtaposed to each other.

* * * * *